US005439714A

United States Patent [19]

Mori et al.

[11] Patent Number: 5,439,714

[45] Date of Patent: Aug. 8, 1995

[54] METHOD FOR THERMAL SPRAYING OF AN INNER SURFACE

[75] Inventors: Kazuhiko Mori, Okazaki; Kenji Shimoda, Nishikamo; Hiroshi Harada, Okazaki, all of Japan

[73] Assignee: Toyota Jidosha Kabushiki Kaisha, Toyota, Japan

[21] Appl. No.: 90,313

[22] Filed: Jul. 13, 1993

[30] Foreign Application Priority Data

Aug. 3, 1992 [JP] Japan ..... 4-206648
Oct. 8, 1992 [JP] Japan ..... 4-270162

[51] Int. Cl.[6] ..... B05D 1/08

[52] U.S. Cl. ..... 427/446; 427/236; 239/515; 239/521; 239/523; 239/524

[58] Field of Search ..... 427/446, 236; 239/513, 239/514, 518, 516, 515, 521, 523, 524

[56] References Cited

U.S. PATENT DOCUMENTS

| | | | |
|---|---|---|---|
| 2,156,370 | 5/1939 | Brownfield | 239/514 |
| 2,859,728 | 11/1958 | Hobdy | 239/514 |
| 3,292,868 | 12/1966 | McCartney et al. | 239/523 |
| 3,785,572 | 1/1974 | Arnold et al. | 239/518 |
| 4,044,217 | 8/1977 | Otsuki et al. | 219/76 |
| 4,499,118 | 2/1985 | Dietz et al. | 427/236 |
| 4,932,591 | 6/1990 | Cruz | 239/514 |
| 5,014,916 | 5/1991 | Trapani et al. | 239/85 |
| 5,080,056 | 1/1992 | Kramer et al. | 92/223 |
| 5,104,916 | 4/1992 | Trinh et al. | 524/71 |

OTHER PUBLICATIONS

Spraying Handbook Edited by Japanese Spraying Association Publication Date 1986 (no month date) pp. 300–303.

*Primary Examiner*—Shrive Beck
*Assistant Examiner*—Katherine A. Bareford
*Attorney, Agent, or Firm*—Oblon, Spivak, McClelland, Maier, Neustadt

[57] ABSTRACT

In order to effect thermal spraying of an inner surface at an optimal thermal spray distance depending upon thermal spray conditions, a method for thermal spraying of the inner surface includes the steps of inserting a thermal spray material bending member 3 having an inclined guide plane 8 at its tip face into the opening so as to face a thermal spray gun 1, moving the thermal spray gun 1 and the thermal spray material bending member 3 in synchronization with each other while maintaining the distance between the thermal spray gun 1 and the thermal spray material bending member 3 at a predetermined value and changing the direction of a thermal spray jet 4 jetted straight from the thermal spray gun 1 by the thermal spray material bending member 3 to spray the thermal spray jet 4 on the inner surface of the opening.

7 Claims, 6 Drawing Sheets

METHOD FOR THERMAL SPRAYING OF AN INNER SURFACE

INDUSTRIAL FIELD OF THE INVENTION

The present invention relates to a method for thermal spraying of an inner surface of an opening in a member having an opening, particularly on an inner surface of an opening in mechanical parts.

BACKGROUND OF THE INVENTION

Thermal spraying is a technique where various thermal spray materials (metals, ceramics and plastics) to be fed into a thermal spray gun are melted with a gas flame or an electric or plasma arc, atomized with a high-pressure gas or inert gas and sprayed on a material to be treated to form a sprayed coating.

The material subjected to the thermal spray has improved corrosion resistance, heat resistance, abrasion resistance and other properties depending upon the properties of the thermal spray material. For example, it is known that thermal spray is effected on the inner periphery of a bore of cylinder blocks of which abrasion resistance is required.

In order to homogeneously spray a thermal spray jet jetted from a thermal spray gun on an inner periphery, the thermal spray has hitherto been effected while rotating the material to be treated. However, the rotation of the material to be treated becomes difficult with an increase in the size of the material to be treated. This has lead to the use of a thermal spray gun having a rotating tip (see U.S. Pat. No. 5,014,916) for the purpose of facilitating the thermal spray on the inner periphery without rotating the material to be treated.

As shown in FIG. 10, a fuel gas, oxygen and compressed air are fed respectively through a fuel gas feed port 8, an oxygen feed port 10 and a compressed air feed port 7 into a thermal spray gun 1 provided on the central axis of the inner periphery of a material 2 to be treated to form a combustion flame. A thermal spray material (a powder) carried from the thermal spray material feed port 9 by a carrier gas is fed into the combustion flame to form a thermal spray jet 4 which is then jetted through the thermal spray gun 1. The tip of the thermal spray gun is rotated by a motor 11 and a belt 12, which are rotating means, and serves to homogeneously spray the thermal spray jet 4 into the material 2 to be treated.

SUMMARY OF THE INVENTION

In general, a thermal spray material (in a powder form) is melted in a thermal spray jet jetted through a thermal spray gun. When the distance from the tip of the thermal spray gun to the material to be treated (thermal spray distance) is excessively short, since the thermal spray material is sprayed in an unmelted state on the material to be treated, the amount of the thermal spray material rebounded without being deposited on the material to be treated becomes large. This lowers the efficiency of deposition of the thermal spray material on the material to be treated. For this reason, it is necessary to ensure a spray distance sufficient for the thermal spray material to be melted in the thermal spray jet (an optimal thermal spray distance). The optimal thermal spray distance depends upon thermal spray conditions, such as melting point, particle diameter and spray rate of the thermal spray material, and is generally in the range of from 100 to 250 mm.

In the above-described thermal spray using a thermal spray gun, since the thermal spray gun is disposed at the center portion of the opening of the material to be treated, the distance from the tip of the thermal spray gun to the material to be treated (inner surface of opening) is determined by the size of the opening, so that it becomes impossible to vary the spray distance according to the thermal spray conditions. For this reason, in some cases, the thermal spray is effected without ensuring the optimal thermal spray distance, which causes the adhesion of the thermal spray material to be deteriorated, so that the percentage of defective sprayed coating becomes high. Accordingly, an object of the present invention is to provide a method for thermal spraying of an inner surface, wherein the distance from the tip of a thermal spray gun to the material to be treated is made regulatable and the optimal thermal spray distance is set according to thermal spray conditions before thermal spraying is effected on the inner surface of the material to be treated. In the prior art, the mechanism for rotating the tip of the thermal spray gun increases the diameter of the thermal spray gun per se, which renders such a thermal spray gun unsuitable for use in the thermal spraying of an opening having a small diameter. Accordingly, another object of the present invention is to provide a method for thermal spraying of the inner surface of an opening without rotating the thermal spray gun.

The thermal spray jet jetted from the spray gun travels straight. It comes into contact with a thermal spray material bending member, which is movable relatively to the thermal spray gun and has an inclined guide plane at its tip face, to change the direction of the advance of the thermal spray material which is then sprayed on the material to be treated. The distance from the tip of the thermal spray gun to the material to be treated is set so that the thermal spray material is completely melted in the thermal spray jet immediately before it is sprayed on the material to be treated, and the thermal spray is effected while maintaining the above-described distance (predetermined distance) by moving the thermal spray gun and the thermal spray material bending member in synchronization with each other. The predetermined distance is a distance determined according to thermal spray conditions, such as a thermal spray material and thermal spray rate, and can be easily set by regulating the distance from the spray gun to the thermal spray material bending member.

DESCRIPTION OF THE PREFERRED EMBODIMENTS

Figure 1:
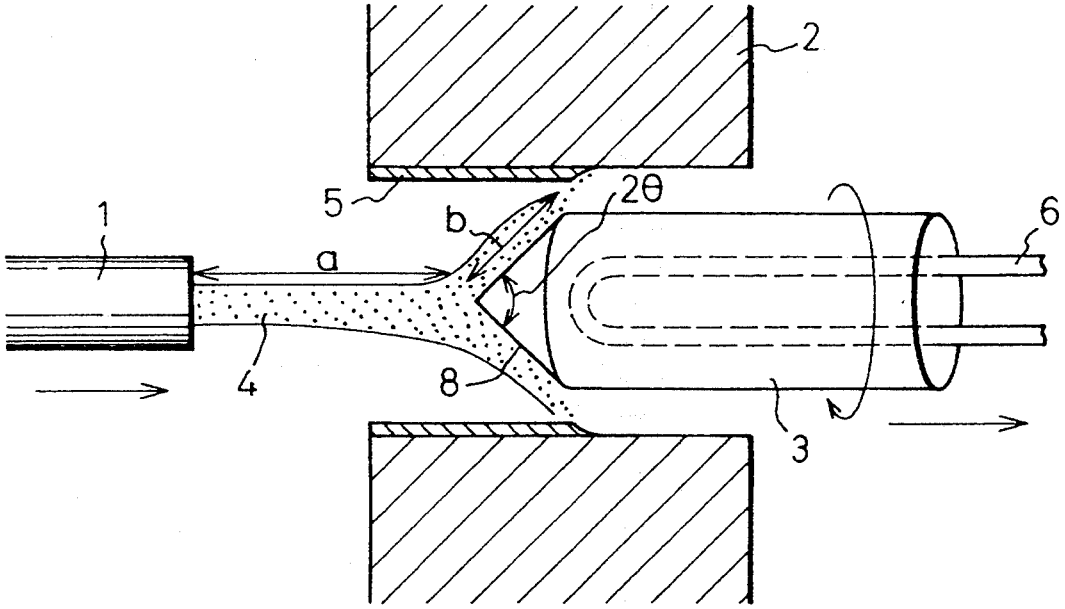
FIG. 1 is a schematic diagram of a thermal spray gun, a thermal spray material bending member and a cylinder block in the case where use is made of a thermal spray material bending member having a conically inclined plane in the thermal spray method according to the present invention.

The present invention is directed to a method for the thermal spraying of an inner surface of an opening in a member having an opening by means of a thermal spray gun, wherein a thermal spray material bending member having an inclined guide plane at its tip face is inserted into the opening so as to face said thermal spray gun and thermal spraying is effected by moving the thermal spray gun and the thermal spray material bending member in synchronization with each other while maintaining the distance between the thermal spray gun and the thermal spray material bending member at a predetermined value.

The inclined guide plane of the thermal spray material bending member serves to change the direction of advance of a thermal spray jet in such a manner that the thermal spray jet jetted straight from a thermal spray gun can be sprayed on a material to be treated. More specifically, the inclined guide plane changes the direction of advance of the thermal spray jet in such a manner that no excessive deposition of the thermal spray material on the thermal spray material bending member occurs and the thermal spray material can be sprayed on the material to be treated at an angle capable of providing a good deposition efficiency.

Since the thermal spray powder material is melted in a thermal spray jet jetted from the thermal spray gun, when the distance from the tip of the thermal spray gun to the material to be treated (thermal spray distance) is excessively short, the thermal spray material is sprayed on the material to be treated in an unmelted state without complete melting in the thermal spray jet, so that the thermal spray material is rebounded without being deposited on the material to be treated. On the other hand, when the spray distance is excessively large, the thermal spray material is completely melted and unfavorably deposited on the thermal spray material bending member before it is deposited on the material to be treated. For this reason, in order to attain a good deposition efficiency, the best method is to set the thermal spray distance to such a value that the thermal spray material is completely melted immediately before it is sprayed on the material to be treated. Such thermal spray distance varies depending upon thermal spray conditions, such as melting point, particle diameter and thermal spray rate of the thermal spray material.

The thermal spray distance set based on the thermal spray conditions can be attained by determining a distance necessary for the thermal spray jet to be bent by the inclined guide plane of the thermal spray material bending member and to reach the material to be treated with consideration of the inner diameter (opening size) of the material to be treated, regulating the distance from the tip of the thermal spray gun to the inclined guide plane at a value equal to the thermal spray distance set based on the thermal spray conditions, and maintaining the thermal spray distance at the predetermined distance.

The inclined guide plane is also the shape of the tip face of the thermal spray material bending member to be inserted into the opening of the material to be treated, and roughly classified into (1) an inclined flat plane and (2) a curved inclined plane. The inclined flat plane includes (A) a conically inclined plane (oblique angle$=\theta$, and vertical angle$=2\theta$) formed by machining the head portion of the thermal spray material bending member into a conical form and (B) an inclined flat plane formed by machining the head portion of the thermal spray material bending member into a flat format an oblique angle $\theta$. On the other hand, the curved inclined plane includes (C) a cylindrically inclined plane, (D) a spherically inclined plane and (E) a parabolically inclined plane formed by respectively removing a part of a cylindrical form, a part of a spherical form and a part of a center line rotator of a parabola from the head portion of the thermal spray material bending member.

EXAMPLES

Examples of the thermal spray method of the present invention will now be described with reference to the accompanying drawings.

Example 1

(Conically Inclined Plane)

FIG. 1 shows the thermal spray of Ni on the inner periphery of a cast iron cylinder block 2 according to the method of the present invention. A thermal spray material bending member 3 comprising 7-3 brass driven by drive means (not shown) in the axial direction and rotating direction of the cylinder block 2 is inserted into the inner periphery of the cylinder block having a diameter of 9 cm. The tip portion of the thermal spray material bending member 3 is in a conical form having a conically inclined plane 8, and a thermal spray gun 1 is provided at a position opposite to the tip portion of the thermal spray material bending member 3 in such a manner that the distance between the thermal spray gun and the thermal spray material bending member is a predetermined one a. The thermal spray gun 1 and the thermal spray material bending member 3 are moved by drive means (not shown) in synchronization with each other while maintaining the predetermined distance a sliding on the center axis of the inner surface of the cylinder block 2.

Figure 2:
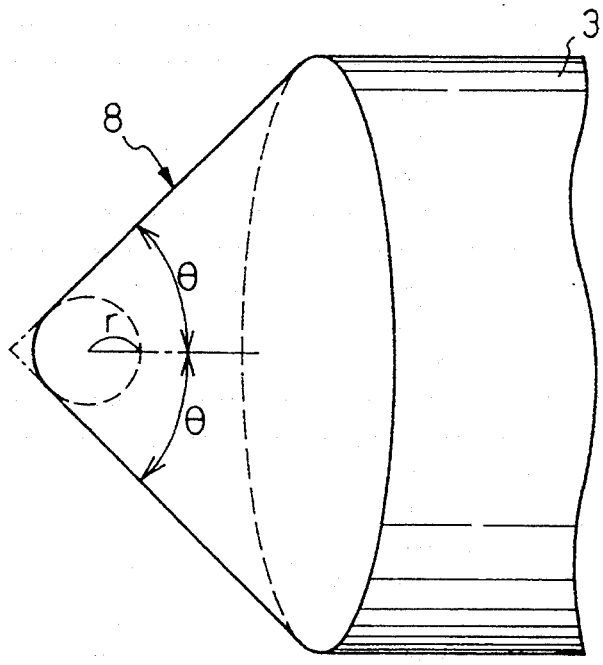
FIG. 2 is an enlarged view of the tip portion of the thermal spray material bending member shown in FIG. 1.

The form of the tip of the thermal spray material bending member 3 is shown in FIG. 2. The cone at the tip of the thermal spray gun has a vertical angle ($2\theta$) of 90°. In this connection, it is noted that, when the vertex of the tip is sharp, there is a possibility that the tip becomes a heat spot and is subjected to melt loss. For this reason, a curved face of a sphere having a radius of 2 mm is incorporated into the tip portion of the cone to eliminate the sharp point of the cone and to render the vertex rounded.

An embodiment wherein a sprayed coating is formed by using a thermal spray device constructed as described above will now be described.

The flow rates of oxygen, propylene and compressed air are respectively set to 279 liters/min, 67 liters/min and 596 liters/min, respectively, and these gases are continuously fed at the above-described respective flow rates into the thermal spray gun 1 through a feed port (not shown). In this case, a mixed gas comprising oxygen and propylene is ignited to give rise to combustion, and compressed air is further added to generate a combustion flame. A Ni powder (−350 mesh) is fed with a carrier gas (argon gas) at a flow rate of 30 liters/min into the combustion flame to form a thermal spray jet 4.

The thermal spray jet containing a thermal spray material, which had been jetted straight from the thermal spray gun 1, collides against the thermal spray material bending member 3 having a vertex angle of 90° to change the direction of the thermal spray jet and is then deposited on the inner periphery of the cylinder block 2 at an incident angle of 45°.

During the thermal spray, the thermal spray gun 1 and the thermal spray material bending member 3 are moved in synchronization with each other by a support member (not shown) while maintaining the distance a at 30 mm so that the distance (a+b) necessary for the thermal spray jet 4 to be jetted from the thermal spray gun 1 and to be deposited on the inner periphery of the cylinder block 2 is maintained at 80 mm. Under thermal spray conditions in this embodiment, the Ni of the thermal spray material is completely melted immediately before deposition thereof on the cylinder block 2 and can be efficiently deposited on the inner surface of the cylinder block 2 by setting the (a+b) value at 80 min.

The thermal spray material bending member 3 is rotated at a rate of 300 rpm for the purpose of homogeneously effecting the thermal spray on the inner surface of the cylinder block 2. When the number of revolutions is excessively small, it is difficult to form a homogeneous coating 5. On the other hand, when the number of revolutions is excessively large, the thermal spray material is blown off, which lowers the thermal spray deposition efficiency. For this reason, the number of revolutions may be in the range of from 10 to 600 rpm.

Thermal spray material bending member 3 is provided with a cooling pipe 6, and water of 25° C. is flowed at a rate of 10 liters/min through the thermal spray material bending member 3 to prevent the temperature of the thermal spray material bending member 3 from being raised by jetting of the thermal spray jet 4.

Figure 3:
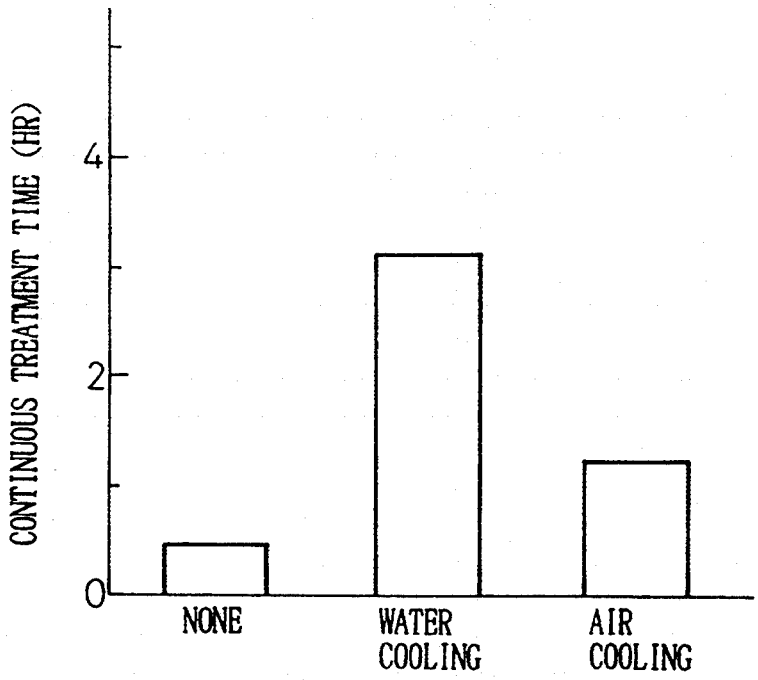
FIG. 3 is a graph showing an effect attained by cooling a thermal spray material bending member.

FIG. 3 is a diagram showing the continuous thermal spray time in the thermal spray with the thermal spray material bending member 3 being cooled in comparison with that in the thermal spray without cooling. In the case of the cooling of the thermal spray material bending member with water according to the present Example, it is possible to continuously effect the treatment for 190 min, and in the case of air cooling, wherein air of 20° C. is flowed through the thermal spray material bending member 3 at a rate of 50 liters/min, it is possible to continuously effect the treatment for 75 min. By contrast, when cooling is not effected at all, the period of time for which the treatment can be continuously effected is as short as 30 min. Thus, continuous thermal spray becomes possible when the thermal spray material bending member 3 is used with cooling.

The material for the thermal spray material bending member 3 is not limited to 7-3 brass used in this Example. However, it is noted that the use of materials having a high melting point is desired from the view point of durability against the high energy of the thermal spray jet. Examples of materials having a high melting point include tungsten and molybdenum.

In the present Example, although a gas was used as the heat source for heating fine particles of the thermal spray material to a melted state, it is also possible to adopt an electricity capable of generating a plasma or an arc.

Figure 4:
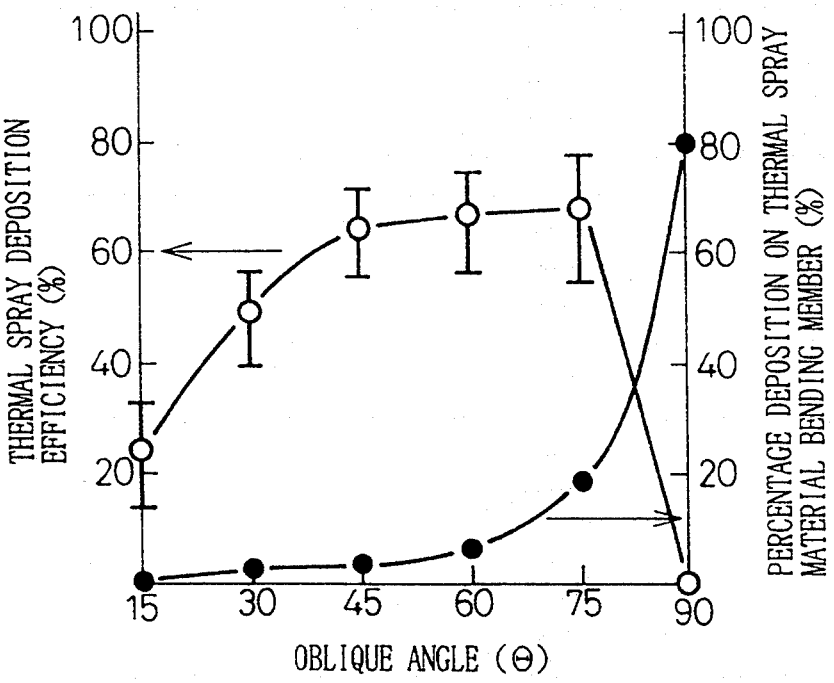
FIG. 4 is a graph showing the relationship between the oblique angle $\theta$ and the efficiency of thermal spray deposition on the surface of a material to be treated in the case where use is made of a thermal spray material bending member having a conically inclined plane in the thermal spray method according to the present invention.

In the present Example, a vortex angle of 90° was provided to the thermal spray material bending member 3 for the purpose of bringing the angle of the inclined guide plane 8 for bending the thermal spray jet 4 (that is, oblique angle: $\theta$) to 45°. In order to clarify the relationship between the oblique angle $\theta$ and the thermal spray efficiency, thermal spraying was effected under the same thermal spray conditions as those used in the present Example using thermal spray material bending members 3 with the angle $\theta$ being varied to determine the efficiency of deposition of the thermal spray material on the inner surface of the cylinder block 2 and the percentage deposition of the thermal spray material on the thermal spray material bending member 3. The results are shown in FIG. 4. As shown in FIG. 4, the efficiency of deposition of the thermal spray material on the inner surface of the cylinder block 2 is 50% or more when the angle $\theta$ of the thermal spray material bending member 3 is 30° to 80°. In particular, when the angle is 45° to 75°, the deposition efficiency is 60% or more. The percentage deposition of the thermal spray material on the thermal spray material bending member 3 rapidly increases when the angle $\theta$ of the thermal spray material bending member 3 exceeds 75°.

When the angle $\theta$ is less than 30°, since the thermal spray jet is sprayed on the inner surface of the cylinder at an angle of less than 30°, the thermal spray material rebounds from the thermal spray material bending member, so that the amount of the thermal spray material, which can be surely deposited on the inner surface of the cylinder block 2, is reduced, which unfavorably results in a lowering in the thermal spray efficiency. On the other hand, when the angle $\theta$ exceeds 75°, since the thermal spray material is unfavorably deposited on the thermal spray material bending member 3 before the thermal spray material reaches the inner surface of the cylinder block 2, so that the thermal spray efficiency remarkably lowers. Therefore, it has been found that, when the thermal spray material bending member has a tip having a conically inclined plane, a useful efficiency of deposition of the thermal spray material on the material to be treated can be attained by setting the angle $\theta$ of the vertex portion at 30° to 75°.

When the form of the thermal spray material bending member is such that the tip portion is conical as in Example 1, as shown in FIG. 2, the tip portion is rendered round to such an extent that a sphere having a radius r of preferably 0.5 to 5.0 mm is drawn within the tip portion. When the r value is less than 0.5 mm, the tip portion of the thermal spray material bending member becomes a heat spot and is subjected to melt loss, while when it exceeds 5 mm, the amount of deposition of thermal spray material on the tip portion unfavorably increases.

Example 2

(Inclined Flat Plane)

Figure 5:
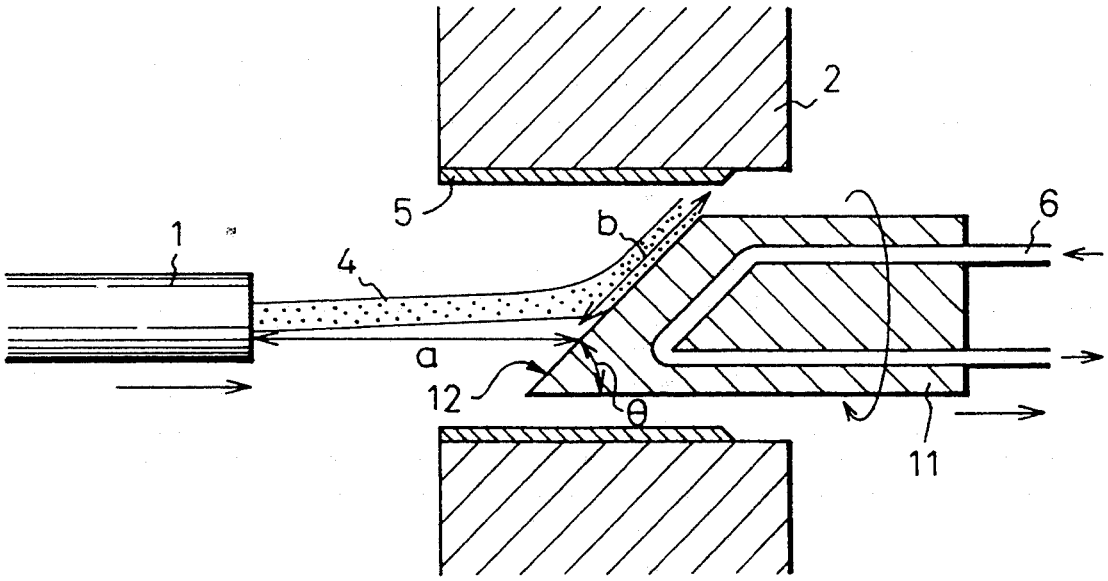
FIG. 5 is a schematic diagram of a thermal spray gun, a thermal spray material bending member and a cylinder block in the case where use is made of a thermal spray material bending member having an inclined flat plane in the thermal spray method according to the present invention.

In this example, as shown in FIG. 5, an inclined flat plane (an elliptical flat surface) 12 formed by the thermal spray material bending member 11 in a round bar formed obliquely at an angle of $\theta$ is used as the inclined guide plane instead of a conically inclined plane provided at the tip portion of the thermal spray material bending member 3 used in Example 1. Thermal spray is effected while maintaining the distance (a+b) from the jetting port to the inner periphery of the cylinder block 2 at a constant value with the thermal spray jet 4 from the thermal spray gun 1 coinciding with the center axis of the thermal spray material bending member 11. As with Example 1, a thermal spray material powder is exposed to a combustion flame of the thermal spray gun 1 to form a thermal spray jet 4 which is bent by the inclined flat plane 12 of the thermal spray material bending member 11 and deposited on the cylinder block 2 at an oblique angle of $\theta$ to form a sprayed coating 5. In order to homogeneously form the sprayed coating 5 all over the surface of the inner periphery of the cylinder block 2, the thermal spray material bending member 11 is rotated at 10 to 600 rpm about the center axis. As with Example 1, the thermal spray material bending member 11 is provided with a cooling pipe 6 that cools the thermal spray material bending member 11.

Thermal spraying of a particular area alone but not all over the periphery of an opening of the material to be treated can be effected in such a manner that the thermal spray material bending member 11 is not rotated and the thermal spray jet is set so as to impinge on the intended area. In this case, the thermal spray material bending member 11 may be in a prism form rather than the round bar form.

In the above-described Examples 1 and 2, the inclined guide plane is flat, and the oblique angle $\theta$, as such, becomes the angle (30° to 75°) of deposition of the thermal spray jet on the face to be treated. It is a common practice to effect the thermal spray at a right angle to the face to be treated, and only in an unavoidable case, the thermal spray at an angle other than the right angle is acceptable. For this reason, it is preferred to use a curved inclined guide plane as in Examples 3 to 5 so that the thermal spray angle is brought close to the right angle (90°).

Example 3

(Cylindrically Inclined Plane)

Figure 6:
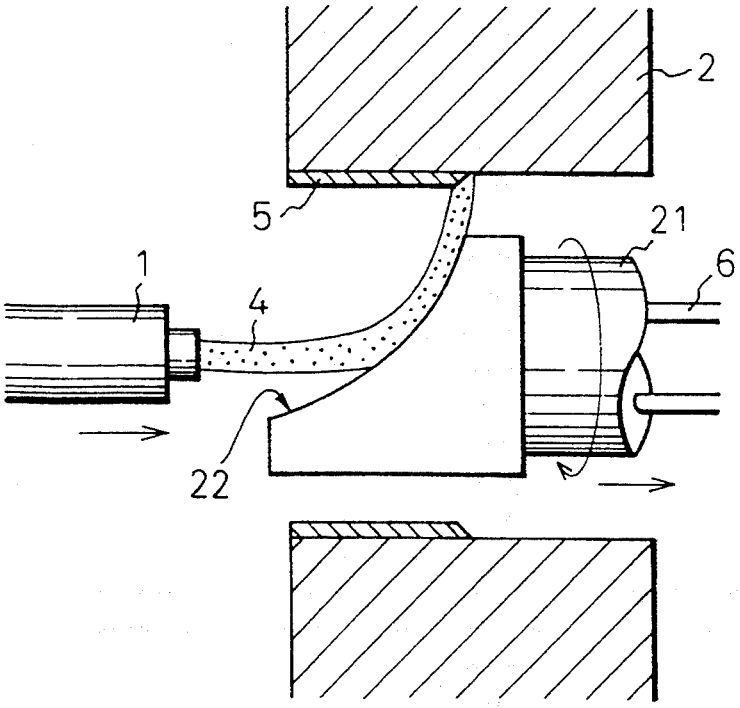
FIG. 6 is a schematic diagram of a thermal spray gun, a thermal spray material bending member and a cylinder block in the case where use is made of a thermal spray material bending member having a cylindrically inclined plane in the thermal spray method according to the present invention.

In this example, as shown in FIG. 6, a cylindrically inclined plane 22, wherein a space formed by removing a part of a round bar and provided at the tip portion of a thermal spray material bending member 21 in a round bar form corresponds to a part of a cylinder, is used as the inclined guide plane instead of the conically inclined plane provided at the tip portion of the thermal spray material bending member 3 used in Example 1. Thermal spray is effected while maintaining the distance from the jetting port to the inner periphery of the cylinder block 2 at a predetermined constant value and rotating the thermal spray material bending member 21 with the thermal spray jet 4 jetted from the thermal spray gun 1 coinciding with the center axis of the thermal spray material bending member 21. As with Example 1, a thermal spray material powder is exposed to a combustion flame of the thermal spray gun 1 to form a thermal spray jet 4 which is bent along the cylindrically inclined plane 22 of the thermal spray material bending member 21 and deposited on the cylinder block 2 at a larger thermal spray angle (at an angle closer to 90°) than that used in Examples 1 and 2, thereby forming a sprayed coating 5.

As with Example 1, the thermal spray material bending member 21 is provided with a cooling pipe 6 and rotated about the center axis thereof. The thermal spray jet 4 is not always required to coincide with the center line of the thermal spray material bending member 21 and may be somewhat deviated from the center line. If the distance between the jetting port and the face to be treated can be maintained at a predetermined value, the thermal spray jet may not coincide (i.e., may not be parallel) with the center line of the thermal spray material bending member 21 but be oblique so that the direction of advance of the jet can be more smoothly changed on the curved surface.

Thermal spraying was effected under the following conditions using the above-described thermal spray material bending member 21 having a cylindrically inclined plane 22 as the inclined guide plane. As a result, as can be seen from FIG. 9, the thermal spray deposition efficiency was about 80%.

| | |
|---|---|
| Thermal spray system: | powder gas thermal spray (HVOF thermal spray) |
| Propylene: | 67 liters/min |
| Oxygen: | 279 liters/min |
| Compressed air: | 596 liters/min |
| Thermal spray material (powder): | Ni—2Si—1B (−350 mesh) |
| Material to be treated: | cast iron cylinder block (FC25) |
| Opening: | cylinder bore (inner diameter: 90 mm) |
| Thermal spray material bending member: | molybdenum |
| Inclined guide plane: | cylindrically inclined plane (radius of cylinder: 75 mm) |
| Number of revolutions of the bending member: | 60 rpm |
| Cooling agent: | water (25° C., 10 liters/min) |

Example 4

(Spherically Inclined Plane)

Figure 7:
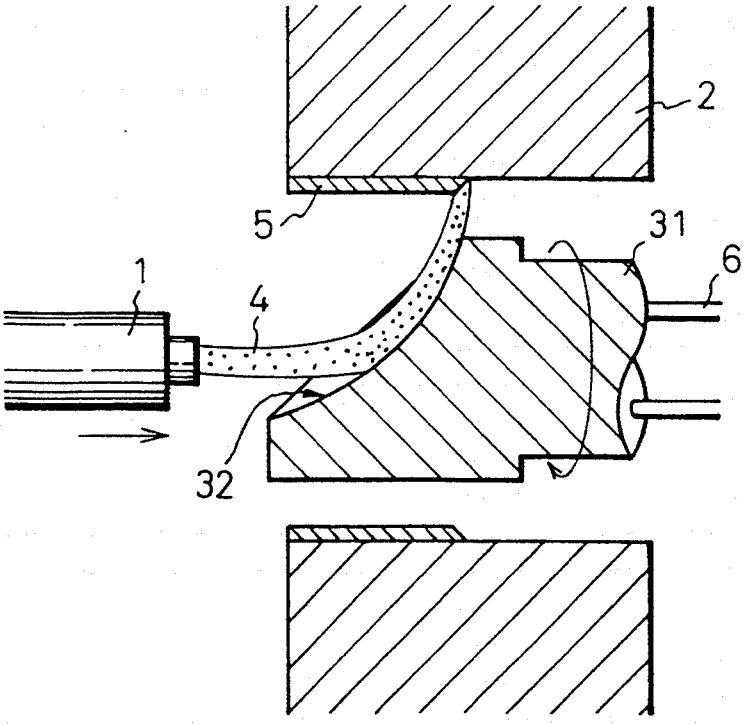
FIG. 7 is a schematic diagram of a thermal spray gun, a thermal spray material bending member and a cylinder block in the case where use is made of a thermal spray material bending member having a spherically inclined plane in the thermal spray method according to the present invention.

In this example, as shown in FIG. 7, a spherically inclined plane 32, wherein a space formed by removing a part of a round bar and provided at the tip portion of a thermal spray material bending member 31 in a round bar form corresponds to a part of a sphere, is used as the inclined guide plane instead of the conically inclined plane provided at the tip portion of the thermal spray material bending member used in Example 1. Thermal spraying is effected while maintaining the distance from the jetting port to the inner periphery of the cylinder block 2 at a predetermined constant value and rotating the thermal spray material bending member 31 with the thermal spray jet 4 jetted from the thermal spray gun 1 coinciding with the center axis of the thermal spray material bending member 31. As with Example 1, a thermal spray material powder is exposed to a combustion flame of the thermal spray gun 1 to form a thermal spray jet 4 which is bent along the spherically inclined plane 32 of the thermal spray material bending member 31 and deposited on the cylinder block 2 at a larger thermal spray angle (at an angle closer to 90°) than that used in Examples 1 and 2, thereby forming a sprayed coating 5.

Thermal spray was effected under the following conditions using the above-described thermal spray material bending member 31 having a spherically inclined plane 32 as the inclined guide plane. As a result, as can be seen from FIG. 9, the thermal spray deposition efficiency was about 86%.

| | |
|---|---|
| Thermal spray system: | powder gas thermal spray (HVOF thermal spray) |
| Propylene: | 55 liters/min |
| Oxygen: | 230 liters/min |
| Compressed air: | 596 liters/min |
| Material to be treated: | aluminum alloy cylinder block |
| Opening: | cylinder bore (inner diameter: 90 mm) |
| Thermal spray material bending member: | 7-3 brass |
| Inclined guide plane: | spherically inclined plane (radius: 75 mm) |
| Number of revolutions of the bending member: | 60 rpm |
| Cooling agent: | water (25° C., 10 liters/min) |

In Examples 1 to 4, although the thermal spraying was effected on the inner periphery of the bore of the cylinder block, the inner periphery of a liner to be inserted into the bore can also be subjected to thermal spraying in the same manner as that used in Examples 1 to 4.

Example 5

(Parabolically Inclined Plane)

When the thermal spraying of an opening having a smaller inner diameter than the above-described examples (for example, inner surface of a compression cylinder) according to the present invention is intended, it is possible to use as the inclined guide plane a part of the shape of the surface of the center line rotator of a parabola for the purpose of reducing the radius of curvature in the curved surface of the guide.

Figure 8:
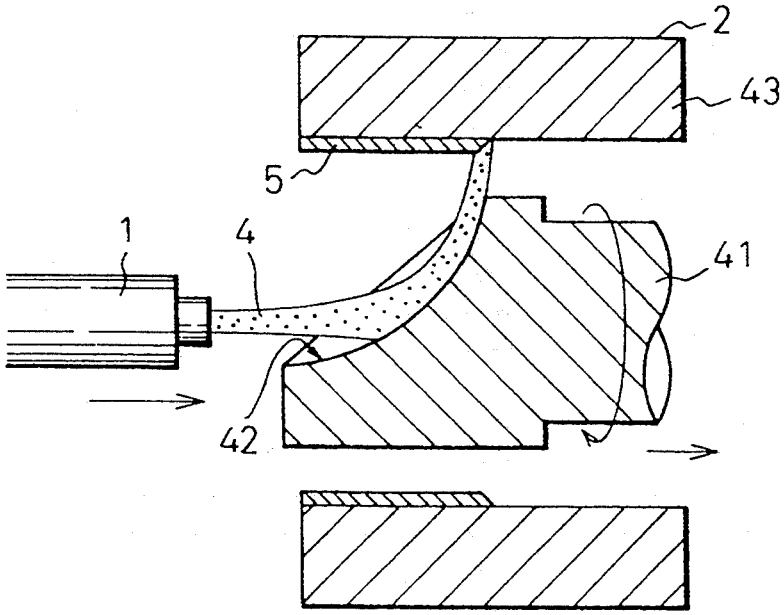
FIG. 8 is a schematic diagram of a thermal spray gun, a thermal spray material bending member and a cylinder block in the case where use is made of a thermal spray material bending member having a parabolically inclined plane in the thermal spray method according to the present invention.

In this example, as shown in FIG. 8, a parabolically inclined plane 42, wherein a space formed by removing a part of a round bar and provided at the tip portion of a thermal spray material bending member 41 in a round bar form corresponds to a part of a parabolic rotator, is used as the inclined guide plane instead of the conically inclined plane provided at the tip portion of the thermal spray material bending member used in Example 1. Thermal spray is effected while maintaining the distance from the jetting port to the inner periphery of the cylinder 43 at a predetermined constant value and rotating the thermal spray material bending member 41 with the thermal spray jet 4 jetted from the thermal spray gun 1 coinciding with the center axis of the thermal spray material bending member 41. As with Example 1, a thermal spray material powder is exposed to a combustion flame of the thermal spray gun 1 to form a thermal spray jet 4 which is bent along the parabolically inclined plane 42 of the thermal spray material bending member 41 and deposited on the cylinder 43 at a larger thermal spray angle (at an angle closer to 90°) than that used in Examples 1 and 2, thereby forming a sprayed coating 5.

Thermal spraying was effected under the following conditions using the above-described thermal spray material bending member 31 having a parabolically inclined plane 42 as the inclined guide plane. As a result, as can be seen from FIG. 9, the thermal spray deposition efficiency was about 86%.

| | |
|---|---|
| Thermal spray system: | microplasma thermal spray |
| Center gas (Ar): | 50 liters/min |
| Powder feeding carrier gas (Ar): | 15 liters/min |
| Material to be treated: | aluminum alloy hydraulic cylinder |
| Inner diameter of cylinder: | 30 mm |
| Thermal spray material bending member: | tungsten |
| Inclined guide plane: | parabolically inclined plane |
| Number of revolutions of the bending member: | 360 rpm |
| Cooling agent: | water (25° C., 10 liters/min) |

In Examples 4 to 5, since the inclined guide plane not only has a curved surface but also is curved inwardly, the thermal spray jet which is liable to diffuse can be narrowed as compared with the curved surface in Example 3 wherein the inclined guide plane is not curved inwardly, which contributes to an enhancement in the thermal spray deposition efficiency.

Figure 9:
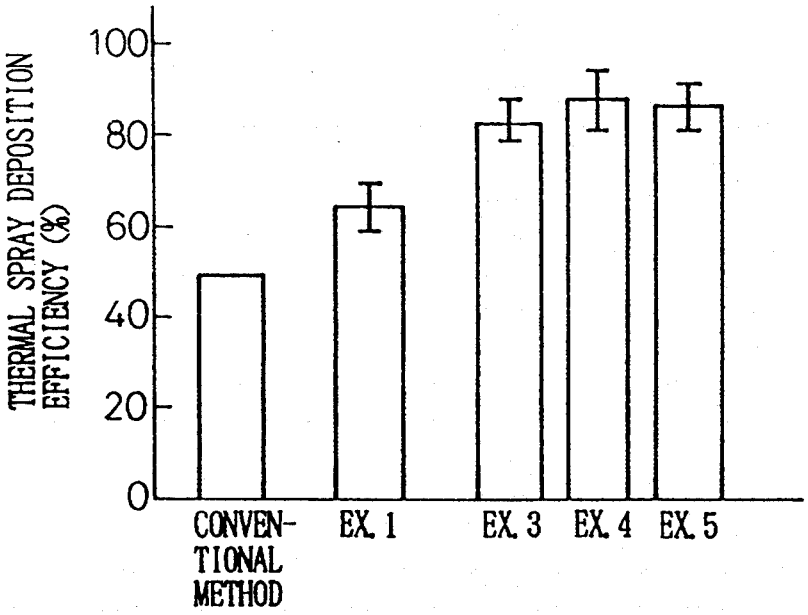
FIG. 9 is a graph showing the efficiency of thermal spray deposition on the surface of a material to be treated according to the present invention and a Comparative Example.
Figure 10:
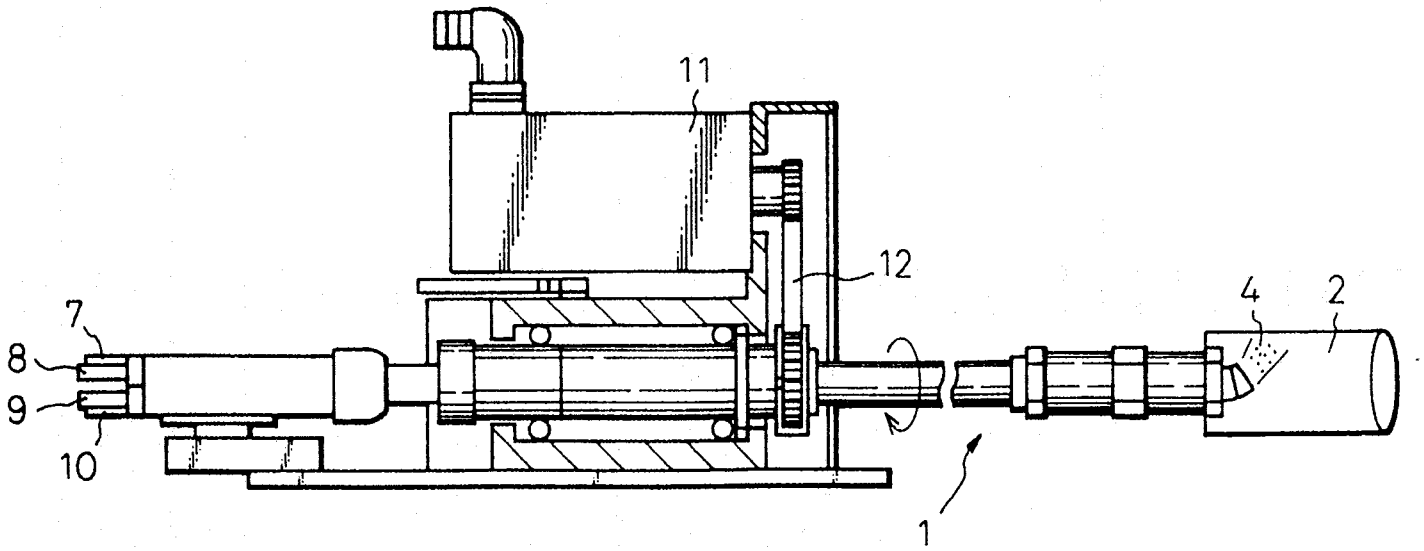
Fig.10 PRIOR ART
FIG. 10 is a schematic view of a thermal spray device used in the conventional method for thermal spraying on an inner periphery.

For comparison, the inner periphery of the cast iron cylinder bore (inner diameter: 90 mm) of the same type as that used in Example 3 was subjected to thermal spraying with a thermal spray material (a Ni alloy powder) by means of a conventional powder gas thermal spray (HVOF thermal spray) gun which has at its tip a nozzle for bringing the thermal spray angle of the thermal spray jet to 45°. As shown in FIG. 9, the thermal spray deposition efficiency in this case was about 50%.

Example 1 in FIG. 9 shows the thermal spray deposition efficiency (about 65%) in the case where the oblique angle is 45° as shown in FIG. 4. The results clearly indicates that, in Example 1, the thermal spray deposition efficiency can be greatly improved over that in Comparative Example although, in both cases, the thermal spray angle is identical (45°).

According to the method of the present invention, the optimal spray distance, which varies depending upon thermal spray conditions, such as particle diameter, melting point and thermal spray rate of thermal spray materials, can be easily ensured simply by varying the distance from the thermal spray gun to the thermal spray material bending member. Therefore, the optimal spray distance can be easily set for every thermal spray conditions, and the thermal spray on the inner surface can be effected at the optimal spray distance.

In the conventional thermal spray guns, since the structure is complicated, the diameter of the guns inevitably becomes so large that such thermal spray guns are not applicable when the material to be treated has a small diameter. By contrast, in the present invention, since the structure of the thermal spray gun can be simplified, the thermal spray can be easily effected even when the material to be treated has a small diameter.

We claim:

1. A method of coating an inner surface of a member with a coating material by use of a thermal spray, comprising the steps of:

positioning a thermal spray gun relative to the member to be coated;

positioning a thermal spray material bending member within the member to be coated;

heating the material in the thermal spray gun to form a thermal spray;

jetting the thermal spray of the heated material from the thermal spray gun;

deflecting the thermal spray onto the inner surface of the member so as to coat the inner surface by positioning the thermal spray material bending member having an inclined guide plate such that the inclined guide plate is not connected to the thermal spray gun and intercepts and deflects the thermal spray;

regulating a spacing of the inclined guide plate from the thermal spray gun during said jetting and deflecting steps such that the material is completely melted immediately before it contacts the inner surface of the member; and moving the thermal spray gun in synchronism with the bending member while maintaining the distance therebetween.

2. The method as claimed in claim 1, in which the inclined guide plate comprises a flat plane interacting with the thermal spray.

3. The method as claimed in claim 1, in which the inclined guide plate comprises a conically inclined plane interacting with the thermal spray.

4. The method as claimed in claim 1, in which the inclined guide plate comprises a cylindrically inclined plane interacting with the thermal spray.

5. The method as claimed in claim 1, in which the inclined guide plate comprises a spherically inclined plane interacting with the thermal spray.

6. The method as claimed in claim 1, in which the inclined guide plate comprises a parabolically inclined plane interacting with the thermal spray.

7. The method as claimed in claim 1, in which the thermal spray material bending member is provided with a cooling device.

* * * * *